US006145959A

United States Patent [19]

Lund et al.

[11] Patent Number: 6,145,959

[45] **Date of Patent: *Nov. 14, 2000**

[54] SWATH DENSITY CONTROL TO IMPROVE PRINT QUALITY AND EXTEND PRINTHEAD LIFE IN INKJET PRINTERS

[75] Inventors: Mark D. Lund, Vancouver, Wash.; Rory A. Heim, Corvallis; Steven T. Castle, Philomath, both of Oreg.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/995,774

[22] Filed: Dec. 22, 1997

[51] Int. Cl.[7] ..... B41J 2/145; B41J 29/38; B41J 29/393; B41J 2/15

[52] U.S. Cl. ..... 347/40; 347/14; 347/17; 347/19

[58] Field of Search ..... 347/40, 19, 17, 347/41, 14

[56] References Cited

U.S. PATENT DOCUMENTS

| | | | |
|---|---|---|---|
| 4,855,752 | 8/1989 | Bergstedt | 347/41 |
| 5,477,245 | 12/1995 | Fuse | 347/10 |
| 5,489,926 | 2/1996 | Arbeiter | 347/16 |
| 5,608,439 | 3/1997 | Arbeiter et al. | 347/102 |
| 5,617,122 | 4/1997 | Numata, et al. | 347/14 |
| 5,644,683 | 7/1997 | Ross et al. | 395/108 |
| 5,760,798 | 6/1998 | Suzuki et al. | 347/14 |

FOREIGN PATENT DOCUMENTS

| | | |
|---|---|---|
| 0300634 | 1/1989 | European Pat. Off. . |
| 0687565 | 12/1995 | European Pat. Off. . |
| 0720917 | 7/1996 | European Pat. Off. . |
| 2744061 | 8/1997 | France . |

OTHER PUBLICATIONS

European Search Report Dated Nov. 12, 1999 for related European Patent Application 98310377.1–2304 Filed Dec. 17, 1998.

*Primary Examiner*—Thinh Nguyen

[57] ABSTRACT

An inkjet printer uses a printhead that passes repeatedly across a print medium in individual swaths. The printhead has individual nozzles that are fired repeatedly during each printhead swath to apply an ink pattern to the print medium. Before any given swath, the printer analyzes factors that might require a reduction in print density. Anticipated printhead temperature is one factor that might require a reduction in print density. The printer monitors the print density and peak printhead temperature during each printhead swath. It then uses these values to calculate, prior to each new swath, a maximum permissible print density. If a reduction in print density is required, the printer temporarily disables selected nozzles to produce a reduced-height swath rather than pausing between swaths or reducing the printhead velocity relative to the page.

44 Claims, 4 Drawing Sheets

SWATH DENSITY CONTROL TO IMPROVE PRINT QUALITY AND EXTEND PRINTHEAD LIFE IN INKJET PRINTERS

TECHNICAL FIELD

This invention relates in general to inkjet printers and in particular to methods of improving print quality and extending printhead life in inkjet printheads by controlling dot densities in printhead swaths.

BACKGROUND OF THE INVENTION

Inkjet printers operate by sweeping a printhead with one or more inkjet nozzles above a print medium and applying a precise quantity of ink from specified nozzles as they pass over specified pixel locations on the print medium. One type of inkjet nozzle utilizes a small resistor to produce heat within an associated ink chamber. To fire a nozzle, a voltage is applied to the resistor. The resulting heat causes ink within the chamber to quickly expand, thereby forcing one or more droplets from the associated nozzle. Resistors are controlled individually for each nozzle to produce a desired pixel pattern as the printhead passes over the print medium.

To achieve higher pixel resolutions, printheads have been designed with large numbers of nozzles. This has created the potential for printhead overheating. Each nozzle firing produces residual heat. If too many nozzles are fired within a short period of time, the printhead can reach undesirably high temperatures. Such temperatures can damage and shorten the life of a printhead. Furthermore, widely varying printhead temperatures during printing can change the size of droplets ejected from the nozzles. This has a detrimental effect on print quality.

Printhead overheating is often the result of a high "dot density" during a single swath of the printhead. When making a swath, the printhead passes over a known number of available pixels, some of which will receive ink and others of which will not receive ink. The pixels that receive ink are referred to as dots. The "dot density" is the percentage of pixels in a swath that receive ink and thereby become dots. When printing many types of images, such as text images, dot densities are relatively low and do not cause overheating. More dense images such as photographic images, however, require a much higher dot density and create the distinct potential for overheating.

Another problem caused by printing high-density images is that there might be insufficient ink in the nozzle area of the printhead for printing the next swath. Over time, firing a nozzle when it has an insufficient supply of ink will destroy the nozzle.

Generally, prior art printers have dealt with both of these problems by pausing the printhead. Where excessive printhead temperature is a concern, a pause is utilized to allow the printhead to cool. Similarly, a pause is used to allow additional ink to flow into the nozzle area of the printhead.

Any significant pause in printing, however, can have undesirable effects on print quality. Random delays between swaths result in horizontal bands with hue shifts. This is because different hues are formed when wet ink lands on ink droplets of various dryness applied during previous, overlapping swaths. Even more significant hue shifts become apparent at start/stop boundaries when pausing in the middle of swaths.

Another way to address the problems of overheating and insufficient ink quantity is to slow the velocity of the printhead as it moves across the print medium. The most significant disadvantage of this tactic is that it consistently reduces throughput for all documents, regardless of their density. A somewhat better approach is to slow the printhead only during swaths that are predicted to cause overheating or low ink quantities. However, this makes drop alignment difficult. The horizontal position of an ink drop is determined partially by the horizontal velocity of the printhead as the ink drop is ejected from the printhead. Thus, it is very difficult to line up the dots from two different swaths if the swaths are printed at different printhead velocities.

Note that each of the problems noted above can also be the result of a slow stream of data from a host. Specifically, a slow data stream can require pauses or slowing of the printhead, causing the described degradations of print quality.

SUMMARY OF THE INVENTION

The invention deals with the need to slow throughput in the three situations described above: when high print density threatens to cause overheating; when high print density reduces ink quantities in the nozzle areas of the printheads; and when a host provides data at a rate slower than the maximum print rate of the printer.

In accordance with the invention, each of these three situations is used to trigger a throughput reduction mode. When operating in this mode, groups of adjacent nozzles are disabled in the printhead, resulting in swaths of less than maximum height. The reduced-height swaths result in lower print density, thereby reducing printhead heating and allowing more ink to flow into the nozzle areas of the printhead. The reduced throughput resulting from the reduced swath height also allows a slower rate of data from a host.

As a result of reducing the number of nozzles used in a particular swath, there is usually no need to pause the printhead either between swaths or during the middle of swaths. Furthermore, there is no need to vary the velocity of the printhead. Accordingly, the invention avoids the hue and drop alignment problems described above.

The invention includes a technique for dynamically determining a maximum permissible swath dot density that will prevent printhead overheating. In accordance with this technique, the printer monitors the swath density and peak printhead temperature for each printhead swath. After each swath, the printer recalculates the maximum permissible swath dot density based on the monitored density and peak temperature of the swath.

DETAILED DESCRIPTION

Figure 1:
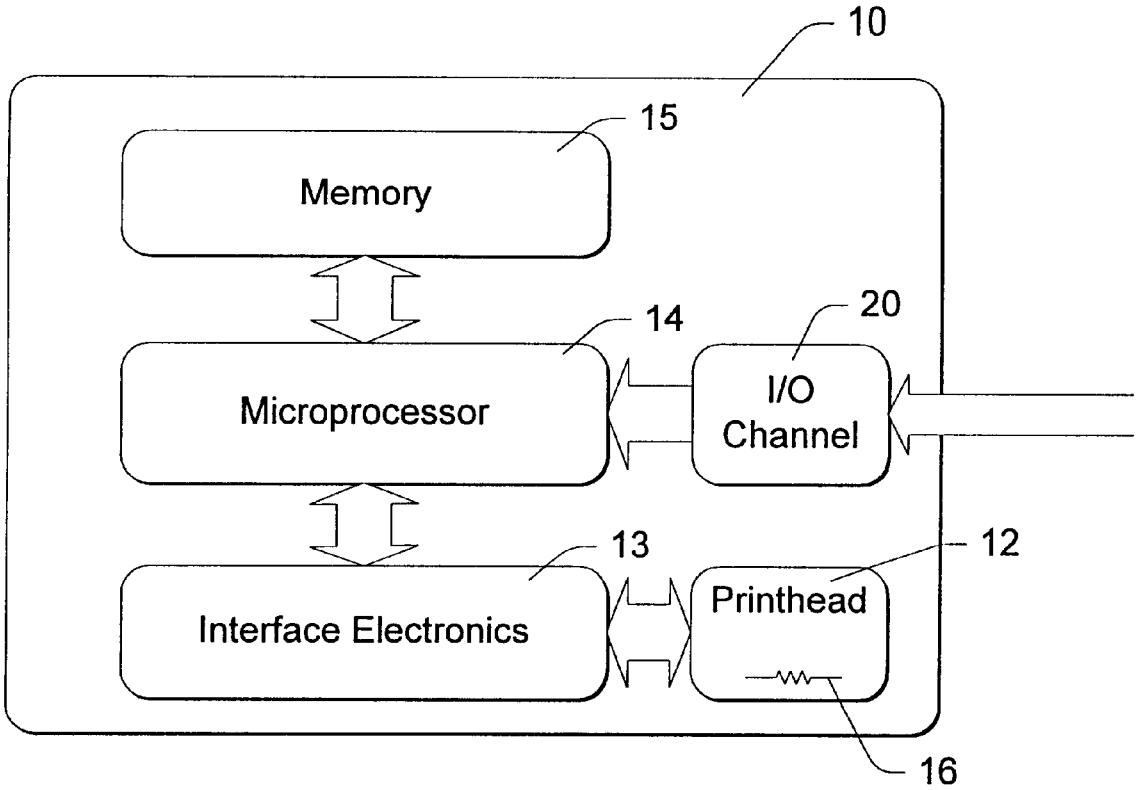
FIG. 1 is a block diagram showing pertinent components of an inkjet printer in accordance with the invention.

FIG. 1 shows pertinent components of a printer 10 in accordance with the invention. Printer 10 is an ink-jet printer having a printhead 12. The printhead has multiple nozzles (not shown in FIG. 1). Interface electronics 13 are associated with printer 10 to interface between the control logic components and the electromechanical components of the printer. Interface electronics 13 include, for example, circuits for moving the printhead and paper, and for firing individual nozzles.

Printer 10 includes control logic in the form of a microprocessor 14 and associated memory 15. Microprocessor 14 is programmable in that it reads and serially executes program instructions from memory. Generally, these instructions carry out various control steps and functions that are typical of inkjet printers. In addition, the microprocessor monitors and controls inkjet peak temperatures as explained in more detail below. Memory 15 is preferably some combination of ROM, dynamic RAM, and possibly some type of nonvolatile and writeable memory such as battery-backed memory or flash memory.

A temperature sensor 16 is associated with the printhead. It is operably connected to supply a printhead temperature measurement to the control logic through interface electronics 13. The temperature sensor in the described embodiment is a thermal sense resistor. It produces an analog signal that is digitized within interface electronics 13 so that it can be read by microprocessor 14. More details regarding the temperature sensor, its calibration, and its use are given in a U.S. patent application filed concurrently herewith, entitled "Method and Apparatus for Detecting the End of Life of a Print Cartridge For a Thermal Ink Jet Printer," having Ser. No. 08/996,013 which is hereby incorporated by reference.

Microprocessor 14 is connected to receive instructions and data from a host computer (not shown) through one or more I/O channels or ports 20. I/O channel 20 is a parallel or serial communications port such as used by many printers.

Figure 2:
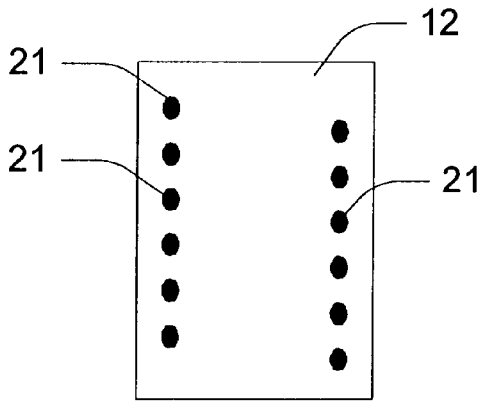
FIG. 2 is a conceptual representation of a printhead such as might be used in the printer of FIG. 1.

FIG. 2 shows an exemplary layout of nozzles 21 in one example of a printhead 12. Printhead 12 has one or more laterally spaced nozzle or dot columns. Each nozzle 21 is positioned at a different vertical position (where the vertical direction is the direction of print medium travel, at a right angle to the direction of printhead travel), and corresponds to a respective pixel row on the underlying print medium. In most swaths of the printhead, all nozzles are used resulting in what is referred to herein as a full-height swath.

Many different printhead configurations are of course possible, and the invention is not limited to the simplified example shown in FIG. 2. In a current embodiment of the invention, for example, the printhead has nozzles corresponding to 288 pixel rows. Also, some printheads utilize redundant columns of nozzles for various purposes. Furthermore, color printers typically have three or more sets of nozzles positioned to apply ink droplets of different colors on the same pixel rows. The sets of nozzles might be contained within a single printhead, or incorporated in three different printheads. The principles of the invention described herein apply in either case.

Generally, printhead 12 is responsive to the control logic implemented by microprocessor 14 and memory 15 to pass repeatedly across a print medium in individual, horizontal swaths. The individual nozzles of the printhead are fired repeatedly during each printhead swath to apply an ink pattern to the print medium. In some printers, the swaths overlap each other so that the printhead passes over each pixel row two or more times.

A printer in accordance with the invention reduces the height of selected swaths to reduce print density for these selected swaths and to thereby control average print density over time while maintaining a uniform swath repetition rate. Swath height is reduced in response to any one of three factors or conditions: (a) a delay in receiving incoming print data; (b) a high print density for the swath, which is predicted to raise the printhead temperature to an unacceptably high level; and (c) a high print density for the swath that is predicted to lower nozzle ink supplies to unacceptably low levels.

In accordance with the invention, the control logic is configured to calculate swath dot density prior to each swath. This swath dot density, referred to as a full swath dot density $D_F$, is the swath density that would result from printing a full-height swath-using all nozzle rows. $D_F$ varies with each swath, depending on the image being printed. The full swath density indicates a ratio of nozzle firings during an individual swath to the number of nozzle firings that would be made during the swath if every nozzle were fired at every pixel in its corresponding row. As described in more detail below, an actual swath can be limited to less than a full swath by using only a subset of the available nozzles in the printhead. Such a swath is referred to herein as a reduced-height swath. An actual swath dot density $D_{ACT}$ is the percentage of nozzle firings that are actually made during a swath as compared to firing every nozzle (including disabled nozzles) at every pixel in the corresponding row. In the case of any given reduced-height swath, $D_{ACT}$ will be less than $D_F$.

After calculating the full swath density for an upcoming swath, the control logic compares it to a maximum permissible swath dot density. If the full swath dot density exceeds the maximum permissible swath dot density, the control logic limits the number of nozzle firings during the upcoming swath. More specifically, the control logic selects and uses only a subset of the available nozzles during the upcoming swath to produce a reduced-height swath with reduced print density. The pixel rows that would have otherwise been printed during the swath are saved for the next swath. This reduces the dot density below the maximum permissible swath dot density.

Figure 3:
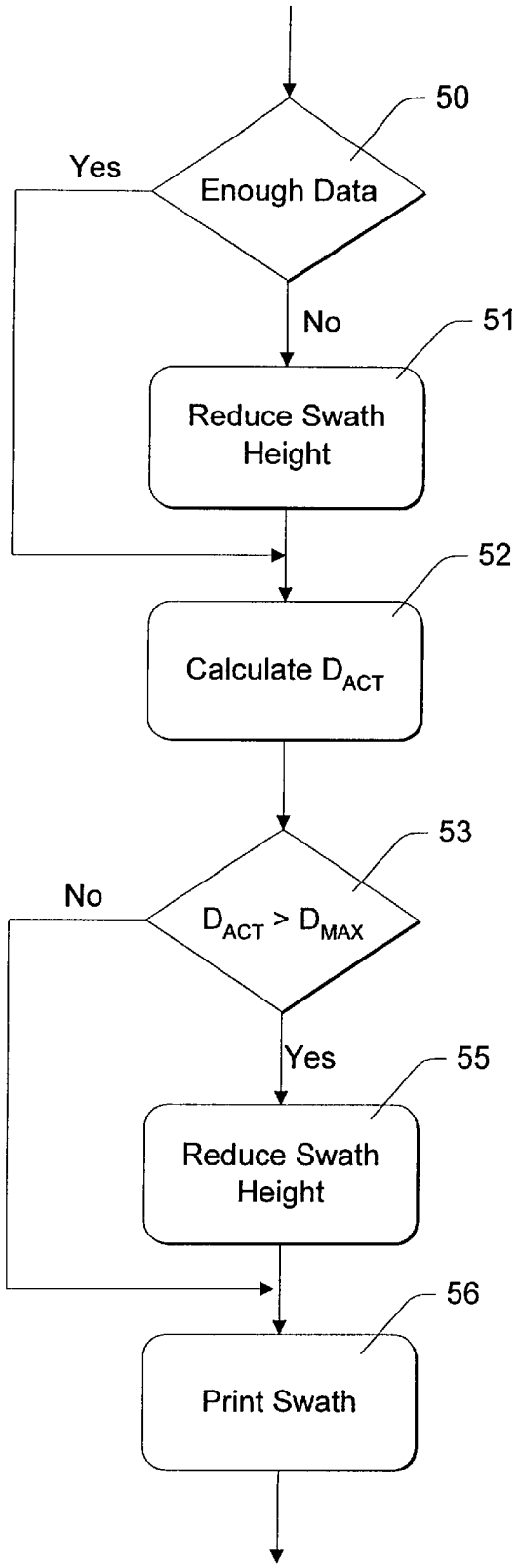
FIGS. 3 and 4 are flowcharts showing steps performed in accordance with the invention.

FIGS. 3 illustrates this method of controlling average printing density. The steps of FIG. 3 are performed by the control logic of printer 10, and are repeated prior to every printhead swath.

A first step 50 comprises checking whether enough data has been received from the host computer to print an entire full swath. If the result of this test is true, execution proceeds with step 52. Otherwise, if not enough data has been received, a step 51 is performed of reducing swath height by selecting a first subset of the nozzles of printhead 12, wherein the nozzles of the subset correspond to pixel rows for which data has already been received. Any nozzles not in this subset are temporarily disabled, meaning that they will not be fired during the upcoming swath.

Step 52 comprises calculating the actual swath density $D_{ACT}$ of the upcoming swath. If step 51 was bypassed, $D_{ACT}=D_F$. Otherwise, $D_{ACT}$ is calculated based on the data for the selected first subset of nozzles that will be used in the upcoming swath. A step 53 comprises comparing $D_{ACT}$ to $D_{MAX}$, where $D_{MAX}$ is the maximum permissible swath density. If $D_{ACT}>D_{MAX}$, a step 55 is performed of selecting a second, smaller subset of the nozzles of printhead 12 for use during the upcoming swath. The second subset is a subset of the first subset. The number of nozzles in the second subset is calculated so that the actual print density $D_{ACT}$ for the swath will be less than or equal to $D_{MAX}$.

In the preferred embodiment, each reduced-height swath is reduced in height by disabling number of nozzles that is an integer multiple of a pre-selected minimum. For example, the number of disabled nozzles might be rounded upwardly to the next highest integer multiple of 16 or 32.

Step 56 comprises performing the printhead swath with the selected subset of nozzles. The control logic monitors the printhead temperature during this step, and records the peak printhead temperature $T_{PEAK}$ for use in steps described below with reference to FIG. 4.

$D_{MAX}$ is a potentially changing number that is maintained by the control logic based on known and measured characteristics of the printhead. The maximum possible ink flow rate establishes the upper limit of $D_{MAX}$. Specifically, the upper limit of $D_{MAX}$ is established at a value that produces an average ink flow rate of less than or equal to the maximum possible flow rate. Subject to this upper limit, $D_{MAX}$ is updated during printer operation based on recorded peak temperatures reached by the printhead during previous swaths having known print densities.

In the described embodiment of the invention, the printer control logic calculates $D_{MAX}$ by monitoring actual swath dot density and the peak printhead 5 temperature $T_{PEAK}$ during each printhead swath and repeatedly (after each swath) calculates $D_{MAX}$ as a function of the actual swath dot density $D_{ACT}$ and peak temperature $T_{PEAK}$. $D_{MAX}$ is calculated so that a printhead swath in which $D_{ACT}=D_{MAX}$ results in a peak printhead temperature that does not exceed a maximum permissible peak printhead temperature $T_{MAX}$.

$D_{MAX}$ is calculated by multiplying the actual swath dot density $D_{ACT}$ of a particular printhead swath by a factor that is based at least in part on the peak temperature $T_{PEAK}$ of the printhead during the swath and upon a specified maximum permissible temperature $T_{MAX}$ of the printhead. In the embodiment described herein, the factor is equal to $(T_{MAX}-T_{START})/(T_{PEAK}-T_{START})$; where $T_{START}$ is equal to the temperature of the printhead prior to the printhead swath. In the embodiment described herein, $T_{START}$ is a constant that approximates the printhead temperature at the beginning of each swath. In the described embodiment, printhead control logic within printer 10 heats or cools the printhead to a target temperature before each printhead swath. $T_{START}$ is equal to this target temperature. Printhead cooling is achieved by imposing a brief delay before an upcoming swath. Printhead heating is achieved by a technique known as "pulse warming," in which nozzles are repeatedly pulsed with electrical pulses of such short duration that they produce heat without ejecting ink.

$D_{MAX}$ is updated after each swath as follows:

$$D_{MAX}=D_{ACT}*((T_{MAX}-T_{START})/(T_{PEAK}-T_{START}))$$

This equation is derived as follows. First, it is assumed that there is a linear relationship between printhead density D and printhead temperature T. Thus, $$T=m*D+T_{START} \quad (1)$$

Given this relationship, $D_{MAX}$ can be calculated in terms $T_{MAX}$, $T_{START}$, and the slope m:

$$D_{MAX}=(T_{MAX}-T_{START})/m \quad (2)$$

Solving for m, $$m=(T_{MAX}-T_{START})/D_{MAX} \quad (3)$$

Substituting equation (3) into equation (1) yields $$T=((T_{MAX}-T_{START})/D_{MAX})*D+T_{START} \quad (4)$$

Solving for $D_{MAX}$, $$D_{MAX}=D*((T_{MAX}-T_{START})/(T-T_{START})) \quad (5)$$

So, given a temperature $T_{PEAK}$ that occurs during a printhead swath having a density $D_{ACT}$, $$D_{MAX}=D_{ACT}*((T_{MAX}-T_{START})/(T_{PEAK}-T_{START})) \quad (6)$$

Actual changes to $D_{MAX}$ are filtered to reduce fluctuations produced by measurement anomalies. One method of filtering is to clip each new value of $D_{MAX}$ at upper and lower limits. In the described embodiment, such clipping is performed only if the printhead temperature $T_{PEAK}$ is outside a defined temperature range, wherein the range includes those temperatures that have been determined to be associated with a linear density/temperature relationship.

Another method of filtering is to damp any changes in the calculated $D_{MAX}$. In the described embodiment, this is done by multiplying changes to $D_{MAX}$ by a predetermined damping factor. Preferably, upward changes in the calculated $D_{MAX}$ are damped by a first damping factor, and downward changes are damped by a second, different damping factor.

Figure 4:
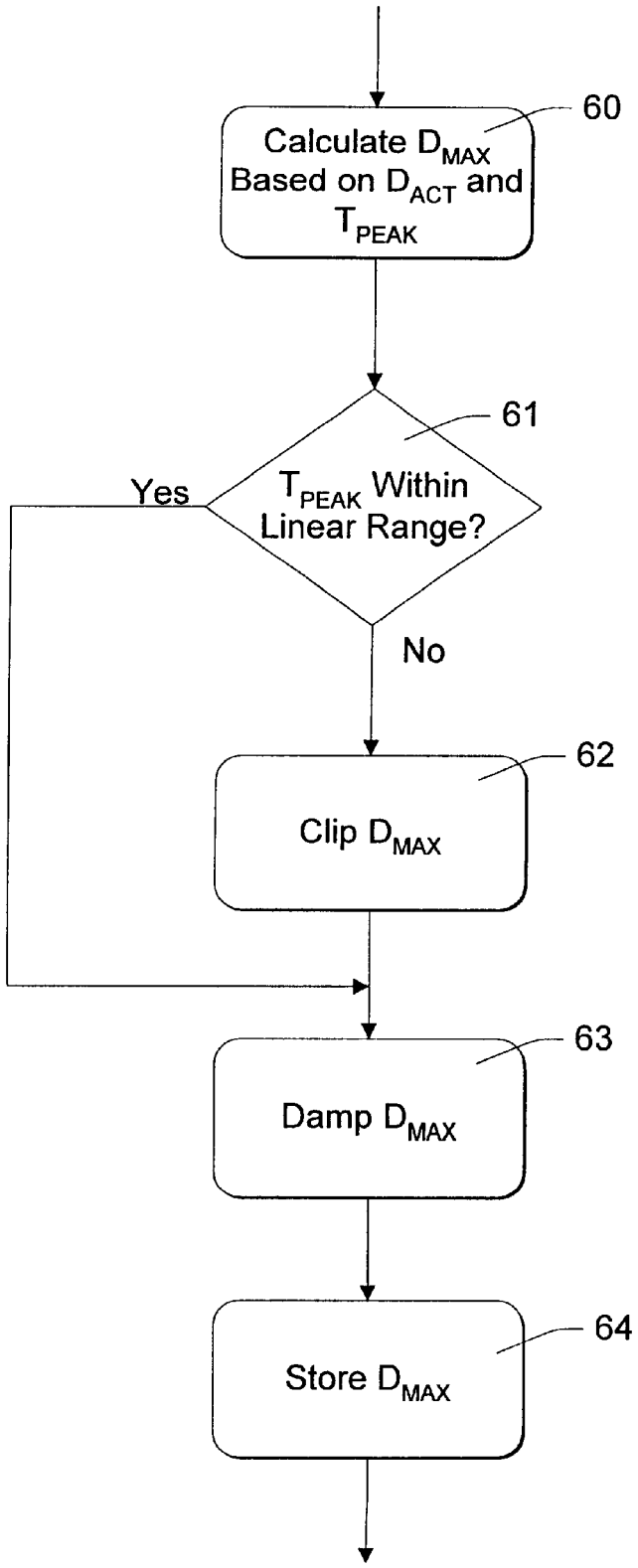

FIG. 4 illustrates the steps involved in calculating $D_{MAX}$. The illustrated steps are performed repeatedly, after each printhead swath. $D_{ACT}$ and $T_{PEAK}$ are recorded during the preceding swath, and are utilized in the calculations of FIG. 4.

A step 60 comprises calculating $D_{MAX}$ as a function of $D_{ACT}$ and $T_{PEAK}$, in accordance with equation (6) above. Subsequent decision step 61 comprises determining whether $T_{PEAK}$ is within a temperature range that exhibits a linear relationship to printhead density. This step comprises comparing $T_{PEAK}-T_{START}$ with a predefined constant that represents the upper temperature limit of linear printhead behavior. If $T_{PEAK}-T_{START}$ is less than or equal to the constant, execution proceeds to step 63. If $T_{PEAK}$ is greater than the constant, a step 62 is performed of clipping $D_{MAX}$ at predefined upper and lower limits. As an example, the upper and lower limits might be set to 95% and 80%, respectively. Step 62 clips or limits $D_{MAX}$ to these values. Any value of $D_{MAX}$ below the lower limit is set equal to the lower limit. Any value of $D_{MAX}$ above the upper limit is set equal to the upper limit.

Performed after the clipping steps described above, step 63 comprises damping changes in $D_{MAX}$ from one printhead pass to another. To do this, the change $\Delta D_{MAX}$ is calculated as the $D_{MAX}-D_{MAXOLD}$, where $D_{MAXOLD}$ is the value of $D_{MAX}$ calculated during the previous iteration of the steps of FIG. 4. $D_{MAX}$ is then damped as follows: $D_{MAX}=D_{MAX}-\Delta D_{MAX}/F_{DAMP}$, where $F_{DAMP}$ is a predetermined damping factor. Alternatively, two different damping factors are used: one when $\Delta D_{MAX}$ is positive, and another when $\Delta D_{MAX}$ is negative. Furthermore, in some cases it may be advantageous to perform damping step 63 only when the absolute value of $\Delta D_{MAX}$ is greater than some predetermined density. This gives a range of $\Delta D_{MAX}$ in which damping is not performed.

Step 64 comprises storing $D_{MAX}$ in non-volatile storage, for retention when the printer is turned off. This value of $D_{MAX}$ is used in step 53 (FIG. 3), prior to the next printhead swath.

Note that the calculations above are based on an assumption that printhead thermal behavior is linear. This simplifies calculations and makes it possible to predict printhead temperatures without requiring significant amounts of non-volatile storage. Other approaches can be used. For example, a different mathematical model (other than the linear model) can be used to predict printhead thermal behavior. Alternatively, a table in printer memory can be maintained, indicating historical peak temperatures corresponding to different printhead densities. In this case, the table is used to determine $D_{MAX}$ rather than the linear model described above.

The method described above of reducing printhead density can be adapted to various different print methodologies. For example, many printers utilize swath overlapping to reduce banding. The principles explained above can be easily incorporated in such printers.

Figure 5:
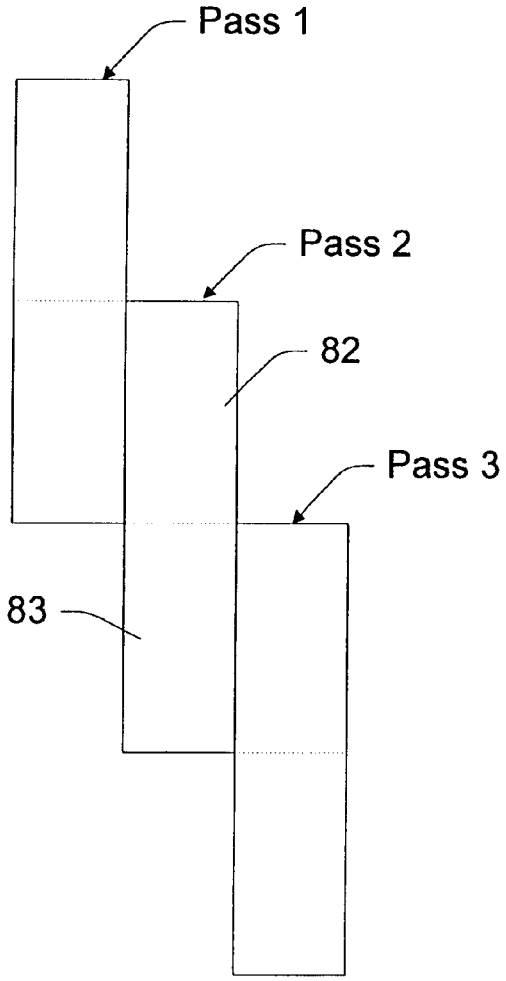
FIGS. 5 and 6 illustrate successive overlapping printhead swaths or passes in accordance with the invention.

As an example, FIG. 5 illustrates two successive swaths in a two-pass printer that uses overlapping swaths. The block designated "Pass 1" illustrates the vertical bounds of a first swath. The block designated "Pass 2" illustrates the vertical bounds of a second, subsequent swath. The block designated "Pass 3" illustrates the vertical bounds of a third swath that is performed after Pass 2. With reference to the second swath, notice that it includes a first band of pixel rows 82 that overlaps pixel rows that were printed by the first swath. In addition the second swath includes a second band of pixel rows 83 that will subsequently be overlapped by the first band of the third swath. Thus, each swath prints an "overlapping" set of dot rows (band 82) over dot rows that were printed by a previous swath, and a "new" set of dot rows (band 83) that are to be overlapped by a subsequent swath. To maintain good print quality, each swath uses a subset of nozzles having at least enough nozzles to overlap the new dot rows that were printed by the previous swath. This puts a limit on the amount of height reduction that can take place during any given swath—each swath must be high enough to completely overlap the "new" portion of the previous swath.

Figure 6:
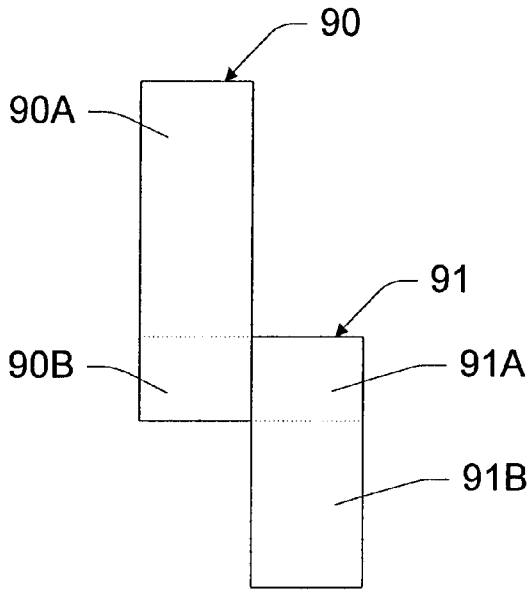

FIG. 6 illustrates a reduced-height swath 90 and a following swath 91. Swath 90 has an overlapping band 90A and a new band 90B. Note that any height reduction is taken from the new band. Following swath 91 similarly has an overlapping band 91A and a new band 91B. Since swath 91 follows a reduced-height band, the overlapping band 91A of swath 91 is reduced in height to match the new band 90B of swath 90. New band 91 B of swath 91 can be reduced to control print density. However, for two-pass printing the new band of any swath should include no more than half of the total pixel rows of a full-height swath. Assuming, as an example, that a printhead has 288 rows of nozzles; the new band of any particular swath should be no higher than 144 (288/2) pixel rows). More generally, for n-swath printing, the new band should be no more than x/n pixel rows, where x is the total number of pixel rows in a full height swath.

Multiple printheads can also be accommodated. When using multiple printheads, the analysis described above is performed independently for each printhead. However the same number of nozzles is used for all printheads in any given swath. The number of nozzles used for a given swath is determined by the printhead whose swath height is reduced the most as a result of the analysis described above.

The invention provides an effective way of controlling print density and printhead temperature to prolong printhead life and to improve print quality. It does this in a way that does not cause hue or dot alignment problems, and that does not unnecessarily reduce print throughput.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

We claim:

1. A method of controlling average printing density over time in an inkjet printer having a printhead with a plurality of nozzles arranged in one or more columns to produce full-height print swath across a print medium, comprising the following steps:

passing the printhead repeatedly across the print medium in individual swaths;

firing individual nozzles repeatedly during each printhead swath to apply an ink pattern to the print medium;

prior to a particular printhead swath, predicting whether the swath has a printhead density that would raise the printhead's temperature to an unacceptably high level;

if the printhead density of said particular printhead swath is predicted to raise the printhead's temperature to an unacceptably high level, using only a subset of the nozzles during said particular swath to produce a reduced-height swath with reduced print density.

2. A method as recited in claim 1, wherein the inkjet printer uses overlapping swaths to print respective dot rows, each swath printing an overlapping set of dot rows over dot rows that were printed by a previous swath and a new set of dot rows that are to be overlapped by a subsequent swath.

3. A method as recited in claim 1, wherein:

the inkjet printer uses overlapping swaths to print respective dot rows, each swath printing an overlapping set of dot rows over dot rows that were printed by a previous swath and a new set of dot rows that are to be overlapped by a subsequent swath;

the subset of nozzles used in each reduced-height swath includes at least enough nozzles to overlap the new dot rows printed by the swath previous to the reduced height swath.

4. A method as recited in claim 1, wherein each reduced-height swath is reduced in height by a number of nozzles that is an integer multiple of a pre-selected minimum.

5. A method as recited in claim 1, wherein the nozzles of the subset correspond to adjacent pixel rows on the print medium.

6. A method of controlling average printing density over time in an inkjet printer having a printhead with a plurality of nozzles arranged in one or more columns to produce full-height print swath across a print medium, comprising the following steps:

passing the printhead repeatedly across a print medium in individual swaths;

firing individual nozzles repeatedly during each printhead swath to apply an ink pattern to the print medium;

detecting a delay in receiving incoming print data prior to a particular swath;

in response to detecting a delay in receiving incoming print data, using only a subset of the nozzles during said particular swath to produce a reduced-height swath with reduced print density, in order to maintain a uniform swath repetition rate.

7. A method of controlling average printing density over time in an inkjet printer having a printhead with a plurality of nozzles arranged in one or more columns to produce full-height print swath across a print medium, comprising the following steps:

passing the printhead repeatedly across a print medium in individual swaths, firing individual nozzles repeatedly during each printhead swath to apply an ink pattern to the print medium;

using only a subset of the nozzles during a particular swath to produce a reduced-height swath with reduced print density;

monitoring actual swath dot density and peak temperature of the printhead during each printhead swath;

repeatedly calculating a maximum permissible swath dot density in response to the monitoring step as a function of the actual swath dot density and peak temperature, wherein the maximum permissible swath dot density results in a peak printhead temperature that does not exceed a maximum permissible peak printhead temperature;

limiting swath dot density to no greater than the maximum permissible swath dot density during individual printhead swaths.

8. A method of controlling average printing density over time in an inkjet printer having a printhead with a plurality of nozzles arranged in one or more columns to produce full-height print swath across a print medium, comprising the following steps:

passing the printhead repeatedly across a print medium in individual swaths;

firing individual nozzles repeatedly during each printhead swath to apply an ink pattern to the print medium;

prior to a particular printhead swath, predicting whether the swath has a printhead density that would lower ink supplies to the nozzles to unacceptably low levels;

if the printhead density of said particular printhead swath is predicted to lower ink supplies to the nozzles to unacceptably low levels, using only a subset of the nozzles during said particular swath to produce a reduced-height swath with reduced print density.

9. A method of controlling average printing density over time in an inkjet printer having a printhead with a plurality of nozzles arranged in one or more columns to produce full-height print swath across a print medium, comprising the following steps:

passing the printhead repeatedly across a print medium in individual swaths;

firing individual nozzles repeatedly during each printhead swath to apply an ink pattern to the print medium;

calculating swath dot density prior to each swath;

if the swath dot density of an upcoming swath is greater than a maximum permissible swath density, using only a subset of the nozzles during the upcoming swath to produce a reduced-height swath with reduced print density.

10. A method as recited in claim 9, wherein the inkjet printer uses overlapping swaths to print respective dot rows, each swath printing an overlapping set of dot rows over dot rows that were printed by a previous swath and a new set of dot rows that are to be overlapped by a subsequent swath.

11. A method as recited in claim 9, wherein:

the inkjet printer uses overlapping swaths to print respective dot rows, each swath printing an overlapping set of dot rows over dot rows that were printed by a previous swath and a new set of dot rows that are to be overlapped by a subsequent swath;

the subset of nozzles used in each reduced-height swath includes at least enough nozzles to overlap the new dot rows printed by the swath previous to the reduced height swath.

12. A method as recited in claim 9, wherein each reduced-height swath is reduced in height by a number of nozzles that is an integer multiple of a pre-selected minimum.

13. A method as recited in claim 9, wherein the nozzles of the subset correspond to adjacent pixel rows on the print medium.

14. An inkjet printer that applies an ink pattern to a print medium, the printer comprising:

control logic;

a printhead that is responsive to the control logic to pass repeatedly across the print medium in individual swaths, the printhead having individual nozzles that are fired repeatedly during each printhead swath to apply an ink pattern to the print medium;

the control logic being configured to perform steps comprising:

calculating swath dot density prior to each swath;

if the swath dot density of an upcoming swath is greater than a maximum permissible swath density, using only a subset of the nozzles during the upcoming swath to produce a reduced-height swath with reduced print density.

15. An inkjet printer as recited in claim 14, wherein the inkjet printer uses overlapping swaths to print respective dot rows, each swath printing an overlapping set of dot rows over dot rows that were printed by a previous swath and a new set of dot rows that are to be overlapped by a subsequent swath.

16. An inkjet printer as recited in claim 14, wherein:

the inkjet printer uses overlapping swaths to print respective dot rows, each swath printing an overlapping set of dot rows over dot rows that were printed by a previous swath and a new set of dot rows that are to be overlapped by a subsequent swath;

the subset of nozzles used in each reduced-height swath includes at least enough nozzles to overlap the new dot rows printed by the swath previous to the reduced height swath.

17. An inkjet printer as recited in claim 14, wherein each reduced-height swath is reduced in height by a number of nozzles that is an integer multiple of a pre-selected minimum.

18. An inkjet printer as recited in claim 14, wherein the nozzles of the subset correspond to adjacent pixel rows on the print medium.

19. A method of controlling printhead temperature in an inkjet printhead having a plurality of nozzles, comprising the following steps:

passing the printhead repeatedly across a print medium in individual swaths;

firing individual nozzles repeatedly during each printhead swath to apply an ink pattern to the print medium;

monitoring actual swath dot density and peak temperature of the printhead during each printhead swath;

repeatedly calculating a maximum permissible swath dot density in response to the monitoring step as a function of the actual swath dot density and peak temperature, wherein the maximum permissible swath dot density results in a peak printhead temperature that does not exceed a maximum permissible peak printhead temperature;

limiting swath dot density to no greater than the maximum permissible swath dot density during individual printhead swaths.

20. A method as recited in claim 19, wherein the limiting step comprises disabling nozzles corresponding to a plurality of pixel rows.

21. A method as recited in claim 19, wherein the calculating step comprises multiplying the actual swath dot density of a particular printhead swath by a factor that is based at least in part on the peak temperature of the printhead during said particular printhead swath.

22. A method as recited in claim 19, wherein the calculating step comprises multiplying the actual swath dot density of a particular printhead swath by a factor that is based at least in part on the peak temperature of the printhead during said particular printhead swath and upon a specified maximum permissible temperature of the printhead.

23. A method as recited in claim 19, wherein the calculating step comprises multiplying the actual swath dot density of a particular printhead swath by a factor that is equal to $(T_{MAX}-T_{START})/(T_{PEAK}-T_{START})$; where $T_{MAX}$ is the peak temperature of the printhead during said particular printhead swath, $T_{PEAK}$ is a specified maximum permissible temperature of the printhead, and $T_{START}$ approximates the temperature of the printhead prior to said particular printhead swath.

24. A method as recited in claim 19, wherein the calculating step comprises multiplying the actual swath dot density of a particular printhead swath by a factor that is equal to $(T_{MAX}-T_{START})/(T_{PEAK}-T_{START})$; where $T_{MAX}$ is the peak temperature of the printhead during said particular printhead swath, $T_{PEAK}$ is a specified maximum permissible temperature of the printhead, and $T_{START}$ is a constant approximating the temperature of the printhead prior to each printhead swath.

25. A method as recited in claim 19, wherein the calculating step comprises damping changes in the calculated maximum permissible swath dot density.

26. A method as recited in claim 19, wherein the calculating step comprises:

damping upward changes in the calculated maximum permissible swath dot density by a first factor; and damping downward changes in the calculated maximum permissible swath dot density by a second factor.

27. A method as recited in claim 19, wherein the calculating step comprises clipping the calculated maximum permissible swath dot density at upper and lower limits.

28. A method as recited in claim 19, wherein the calculating step comprises clipping the calculated maximum permissible swath dot density at upper and lower limits if the printhead temperature during said particular printhead swath is outside a defined range.

29. A method as recited in claim 19, wherein the calculating step comprises:

multiplying the actual swath dot density of a particular printhead swath by a factor that is based at least in part on the peak temperature of the printhead during said particular printhead swath;

clipping the calculated maximum permissible swath dot density at upper and lower limits;

damping changes in the calculated maximum permissible swath dot density.

30. A method as recited in claim 19, wherein the calculating step comprises:

multiplying the actual swath dot density of a particular printhead swath by a factor that is equal to $(T_{MAX}-T_{START})/(T_{PEAK}-T_{START})$; where $T_{MAX}$ is the peak temperature of the printhead during said particular printhead swath, $T_{PEAK}$ is a specified maximum permissible temperature of the printhead, and $T_{START}$ approximates the temperature of the printhead prior to said particular printhead swath;

damping upward changes in the calculated maximum permissible swath dot density by a first factor; and damping downward changes in the calculated maximum permissible swath dot density by a second factor;

clipping the calculated maximum permissible swath dot density at upper and lower limits if the printhead temperature during said particular printhead swath is outside a defined range.

31. A method of controlling printhead temperature in an inkjet printhead having a plurality of nozzles, comprising the following steps:

passing the printhead repeatedly across a print medium in individual swaths;

firing individual nozzles repeatedly during each printhead swath to apply an ink pattern to the print medium;

monitoring actual swath dot density and peak temperature of the printhead during each printhead swath;

repeatedly calculating a maximum permissible swath dot density in response to the monitoring step as a function of the actual swath dot density and peak temperature, wherein the maximum permissible swath dot density results in a peak printhead temperature that does not exceed a maximum permissible peak printhead temperature;

using only a subset of the individual nozzles during a particular printhead swath to limit swath dot density to no greater than the maximum permissible swath dot density.

32. A method as recited in claim 31, wherein the nozzles of the subset correspond to adjacent pixel rows on the print medium.

33. A method as recited in claim 31, wherein the calculating step comprises multiplying the actual swath dot density of a particular printhead swath by a factor that is based at least in part on the peak temperature of the printhead during said particular printhead swath and upon a specified maximum permissible temperature of the printhead.

34. A method as recited in claim 31, wherein the calculating step comprises multiplying the actual swath dot density of a particular printhead swath by a factor that is equal to $(T_{MAX}-T_{START})/(T_{PEAK}-T_{START})$; where $T_{MAX}$ is the peak temperature of the printhead during said particular printhead swath, $T_{PEAK}$ is a specified maximum permissible temperature of the printhead, and $T_{START}$ approximates the temperature of the printhead prior to said particular printhead swath.

35. A method as recited in claim 31, wherein the calculating step comprises damping changes in the calculated maximum permissible swath dot density.

36. A method as recited in claim 31, wherein the calculating step comprises clipping the calculated maximum permissible swath dot density at upper and lower limits.

37. A method as recited in claim 31, wherein the calculating step comprises:

multiplying the actual swath dot density of a particular printhead swath by a factor that is equal to $(T_{MAX}-T_{START})/(T_{PEAK}-T_{START})$; where $T_{MAX}$ is the peak temperature of the printhead during said particular printhead swath, $T_{PEAK}$ is a specified maximum permissible temperature of the printhead, and $T_{START}$ approximates the temperature of the printhead prior to said particular printhead swath;

damping upward changes in the calculated maximum permissible swath dot density by a first factor; and damping downward changes in the calculated maximum permissible swath dot density by a second factor;

clipping the calculated maximum permissible swath dot density at upper and lower limits if the printhead temperature during said particular printhead swath is outside a defined range.

38. An inkjet printer that applies an ink pattern to a print medium, the printer comprising:

control logic;

a printhead that is responsive to the control logic to pass repeatedly across the print medium in individual swaths, the printhead having individual nozzles that are fired repeatedly during each printhead swath to apply an ink pattern to the print medium;

a temperature sensor associated with the printhead, the temperature sensor being operably connected to supply a printhead temperature measurement to the control logic;

the control logic being configured to perform steps comprising:

monitoring actual swath dot density and peak temperature of the printhead during each printhead swath;

repeatedly calculating a maximum permissible swath dot density in response to the monitoring step as a function of the actual swath dot density and peak temperature, wherein the maximum permissible swath dot density results in a peak printhead temperature that does not exceed a maximum permissible peak printhead temperature;

limiting swath dot density to no greater than the maximum permissible swath dot density during individual printhead swaths.

39. An inkjet printer as recited in claim 38, wherein the limiting step comprises disabling nozzles corresponding to a plurality of pixel rows.

40. An inkjet printer as recited in claim 38, wherein the calculating step comprises multiplying the actual swath dot density of a particular printhead swath by a factor that is based at least in part on the peak temperature of the printhead during said particular printhead swath.

41. An inkjet printer as recited in claim 38, wherein the calculating step comprises multiplying the actual swath dot density of a particular printhead swath by a factor that is equal to $(T_{MAX}-T_{START})/(T_{PEAK}-T_{START})$; where $T_{MAX}$ is the peak temperature of the printhead during said particular printhead swath, $T_{PEAK}$ is a specified maximum permissible temperature of the printhead, and $T_{START}$ approximates the temperature of the printhead prior to said particular printhead swath.

42. An inkjet printer as recited in claim 38, wherein the calculating step comprises damping changes in the calculated maximum permissible swath dot density.

43. An inkjet printer as recited in claim 38, wherein the calculating step comprises clipping the calculated maximum permissible swath dot density at upper and lower limits.

44. An inkjet printer as recited in claim 38, wherein the calculating step comprises:

multiplying the actual swath dot density of a particular printhead swath by a factor that is equal to $(T_{MAX}-T_{START})/(T_{PEAK}-T_{START})$; where $T_{MAX}$ is the peak temperature of the printhead during said particular printhead swath, $T_{PEAK}$ is a specified maximum permissible temperature of the printhead, and $T_{START}$ is the temperature of the printhead prior to said particular printhead swath;

damping upward changes in the calculated maximum permissible swath dot density by a first factor; and damping downward changes in the calculated maximum permissible swath dot density by a second factor;

clipping the calculated maximum permissible swath dot density at upper and lower limits if the printhead temperature during said particular printhead swath is outside a defined range.

* * * * *